US005918340A

United States Patent [19]

Young

[11] Patent Number: 5,918,340

[45] Date of Patent: Jul. 6, 1999

[54] MOPHEADS

[75] Inventor: Ronald Scot Young, St. Joseph, Mo.

[73] Assignee: Scot Young Research, Inc., St. Joseph, Mo.

[21] Appl. No.: 09/004,687

[22] Filed: Jan. 8, 1998

[30] Foreign Application Priority Data

Mar. 13, 1997 [GB] United Kingdom ..... 9705239

[51] Int. Cl.[6] ..... A47L 13/12

[52] U.S. Cl. ..... 15/115; 15/118; 15/147.1; 15/150; 15/229.2

[58] Field of Search ..... 15/115, 118, 147.1, 15/150, 151, 228, 229.1, 229.2, 229.6

[56] References Cited

U.S. PATENT DOCUMENTS

| | | | |
|---|---|---|---|
| 1,526,528 | 2/1925 | Christy | 15/229.1 |
| 1,739,704 | 12/1929 | Yancey | 15/120.2 |
| 1,781,237 | 11/1930 | Merkle | 15/120.2 |
| 1,840,189 | 1/1932 | Dwork | 15/150 X |
| 2,482,163 | 9/1949 | Finnell | 15/118 |
| 2,683,886 | 7/1954 | Neumann | 15/150 X |
| 2,825,914 | 3/1958 | Moss | 15/229.1 |
| 2,845,643 | 8/1958 | Provencal et al. | 15/115 X |
| 2,887,712 | 5/1959 | Vosbikian et al. | 15/230 |
| 3,324,497 | 6/1967 | Moss | 15/229.2 |
| 3,336,620 | 8/1967 | Moss | 15/229.2 |
| 3,398,420 | 8/1968 | Manning | 15/150 |
| 3,399,499 | 9/1968 | Stetz et al. | 15/118 X |
| 3,432,873 | 3/1969 | Moss | 15/118 |
| 3,457,581 | 7/1969 | Oas | 15/147.1 |
| 3,501,796 | 3/1970 | Moss | 15/118 |
| 3,795,934 | 3/1974 | Moss | 15/229.2 |
| 3,817,004 | 6/1974 | Moss | 451/532 |
| 4,287,632 | 9/1981 | Hammond | 15/150 |
| 4,422,203 | 12/1983 | Zenker | 15/150 |
| 4,524,479 | 6/1985 | Wright | 15/147.1 |
| 4,553,282 | 11/1985 | Batchelor | 15/150 |
| 4,675,932 | 6/1987 | Hofacker, Jr. | 15/118 |
| 4,679,859 | 7/1987 | Wilson | 300/21 |
| 4,995,134 | 2/1991 | Monahan | 15/151 |
| 5,319,822 | 6/1994 | Shaw | 15/146 |

FOREIGN PATENT DOCUMENTS

| | | |
|---|---|---|
| 503667 | 6/1920 | France . |
| 27 40 417 | 3/1978 | Germany . |
| 29 09 617 | 9/1980 | Germany . |
| 3802198 | 6/1989 | Germany . |
| 105448 | 6/1924 | Switzerland . |
| 960563 | 6/1964 | United Kingdom . |
| 2 298 128 | 8/1996 | United Kingdom . |
| 2 315 407 | 2/1998 | United Kingdom . |

*Primary Examiner*—Mark Spisich
*Attorney, Agent, or Firm*—Wm. Bruce Day

[57] ABSTRACT

A holder for releasibly clamping a mophead to a mop handle includes an elongate clamping member which is hinged at one end and snap fits at the other. The clamping member extends about a mop strand bundle. The clamping member has a brush or scrub pad fitted to its underside for scrubbing.

8 Claims, 3 Drawing Sheets

MOPHEADS

Figure 1:
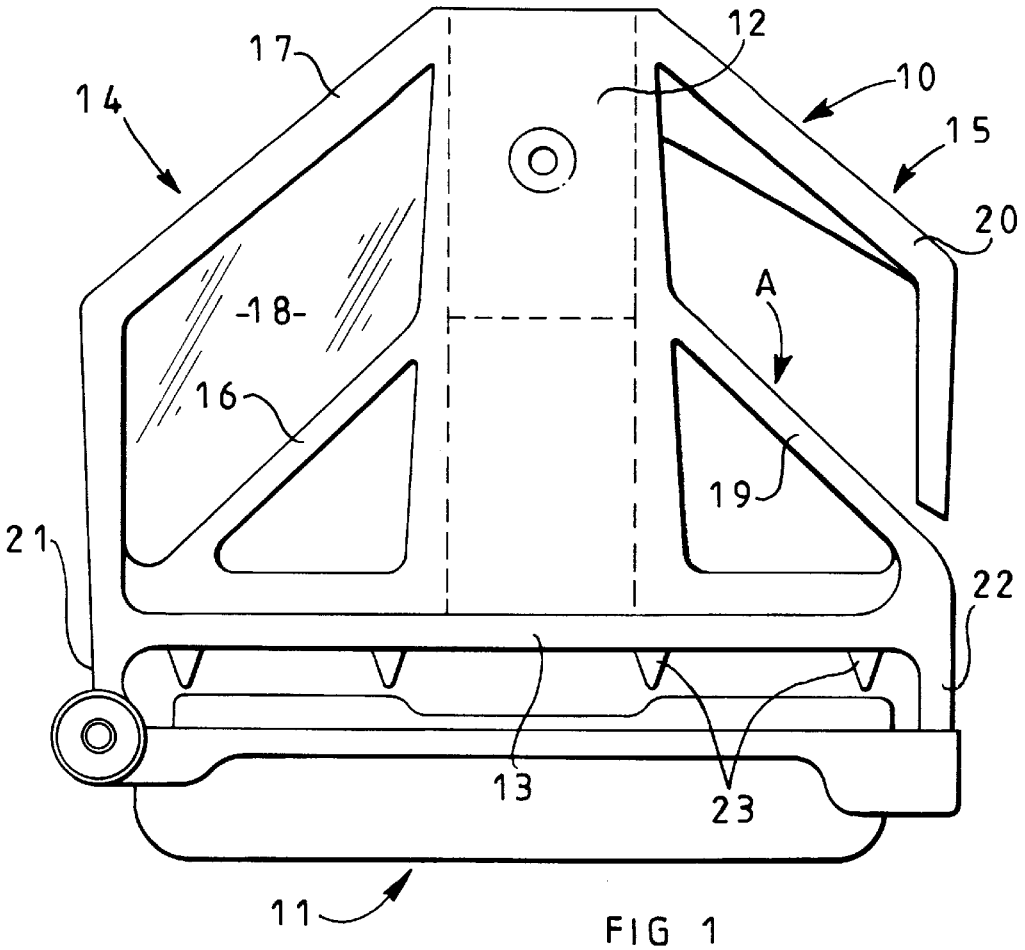

This invention relates to mopheads for mops which are used, primarily, for wet mopping of floors.

Mops comprise a mophead and a handle. The mophead is generally formed from a bundle of flexible strands (sometimes referred to a "threads") which are gathered together at the centre (to define two fan shaped parts) where they are secured to a holder, such as by a non-releasable staple. The holder is attached to the handle.

According to the present invention there is provided a mophead comprising a holder and a bundle of flexible strands which are gathered together at the centre where they are held by the holder, the holder comprising a body part for attachment to a mop handle and a releasable clamping member for releasably clamping the bundle of strands to the body part of the holder, the holder also supporting a scrub pad or a brush on the underside of the strand bundle.

Preferably, the clamping member is elongate and is hingedly connected at one end to the body part and is releasably connected at its other end with the body part.

Alternatively, the clamping member is elongate and is releasably connected with the body part at its two ends.

Preferably, the body part of the holder has a plurality of prongs which project into the bundle of strands when the bundle is clamped by the holder.

Preferably, the holder supports a brush on the underside of the mophead. In this case, the brush bristles are, preferably, directly secured to the clamping member and, in this case, there are, preferably, two groups of brush bristles one on either side of a plane of symmetry of the mophead, each group, preferably, extending at an acute angle to the said plane of symmetry.

Alternatively, the holder supports a scrub pad on the underside of the mophead. In this case, the abrasive pad is, preferably, clamped between the clamping member and body part of the holder on the underside of the bundle of flexible strands.

Preferably, the strands of the bundle are connected together at positions spaced from but adjacent to each of their two ends, each edge portion of each mop half being connected to an adjacent edge portion of the other mop half and the length of the strands and the width of the strands where gathered together at the centre being such that a user may selectively use the entire undersurface of the mophead or the upper surfaces of the two mop halves for mopping.

More particularly, the mophead preferably comprises a generally rectangular bundle of flexible strands presenting opposed first and second ends, opposed side edges, and a centre intermediate the ends, the strands of the bundle being held together at the centre to divide the bundle into a pair of mop halves, a first band for holding the strands of the bundle together near the first end of the bundle, a second band for holding the strands of the bundle together near the second end of the bundle, the first and second bands each presenting opposed ends disposed at the side edges of the bundle, the ends of the first band being connected to the ends of the second band to permit the two halves of the mophead to be parted by applying a twirling action to the holder.

Preferably, the centre portion has a width of at least 7.5 cm and, more preferably a width of at least 10 cm and, yet more preferably, a width of at least 12 cm.

Preferably, each of said mop halves has a length of at least 25 cm and, more preferably, a length of at least 30 cm.

Figure 2:
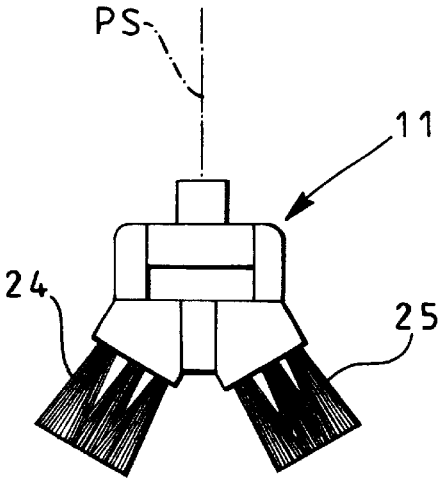
Figure 3:
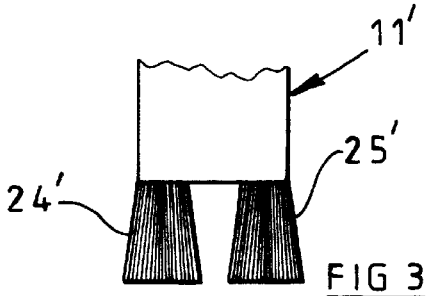
Figure 4:
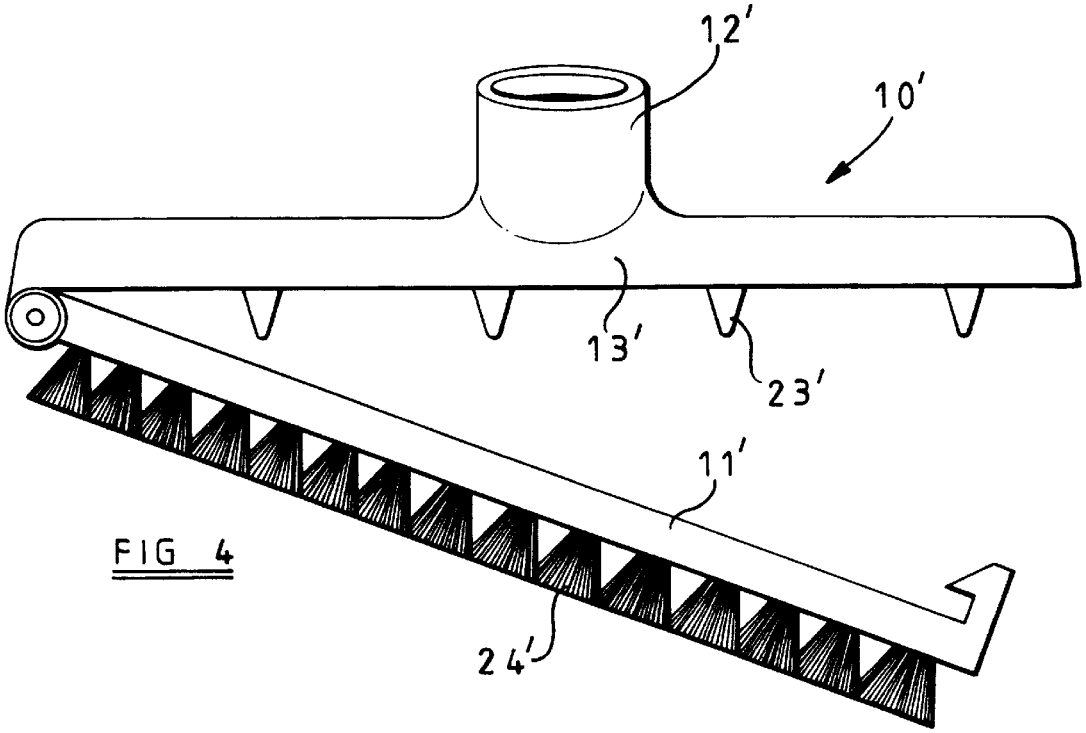
Figure 5:
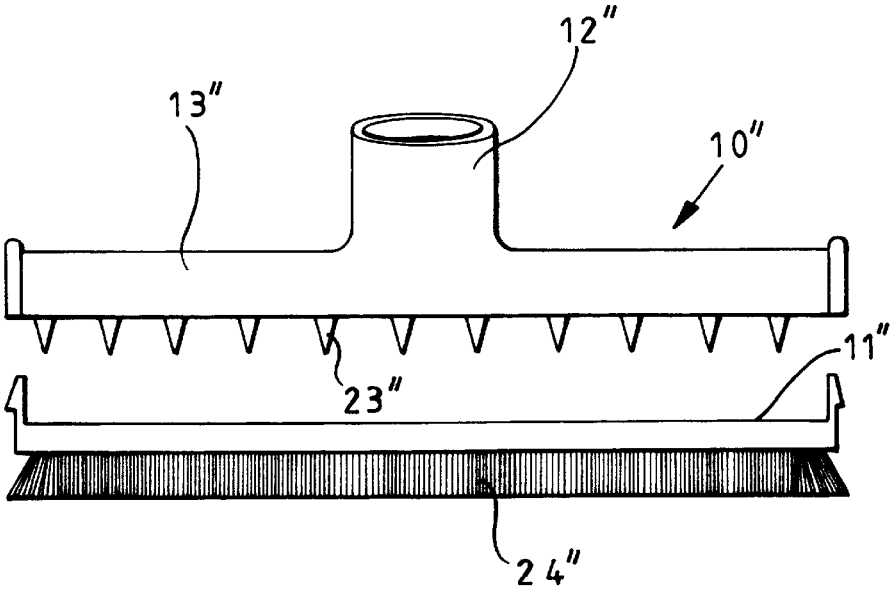
Figure 6:
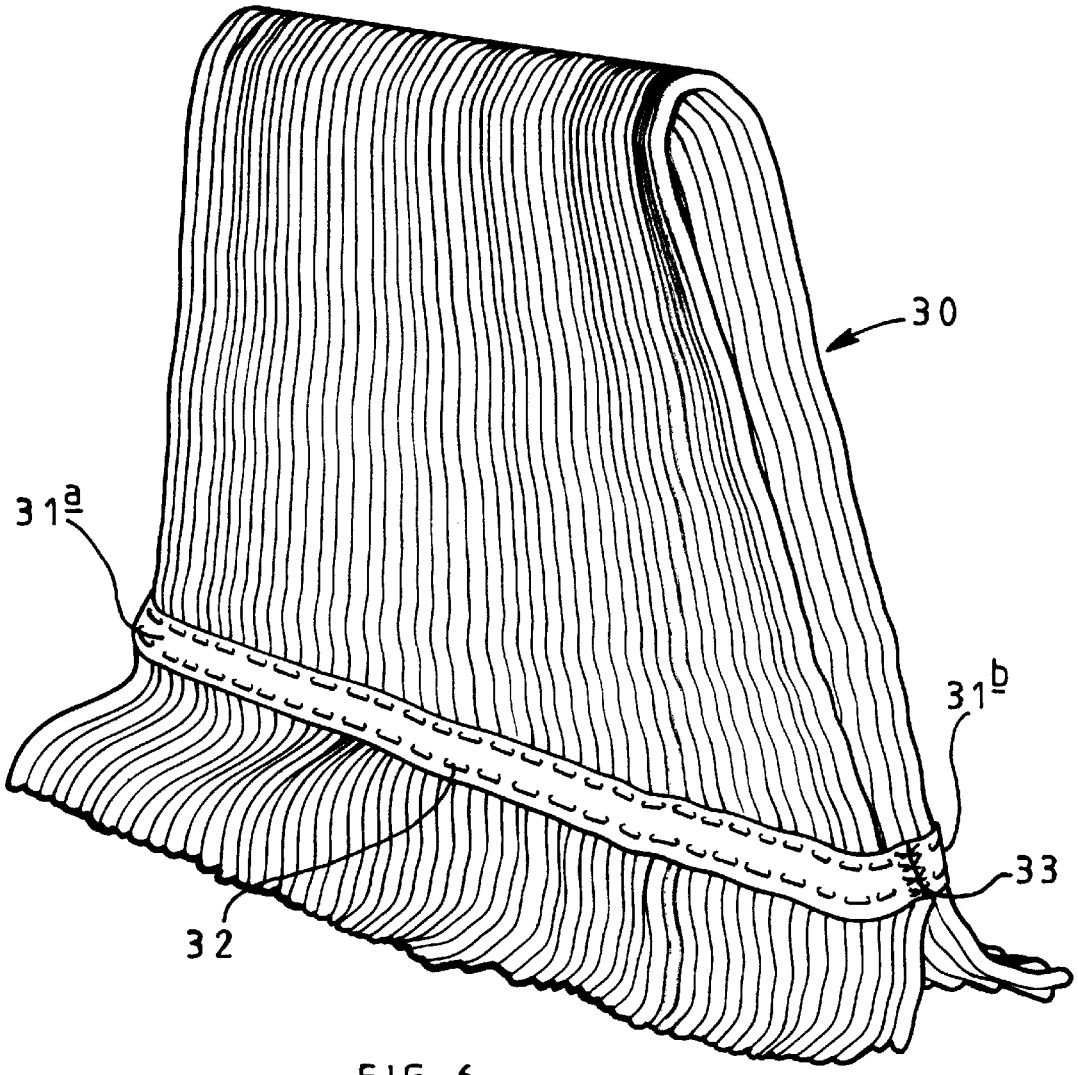

The invention will now be more particularly described, by way of example, with reference to the accompanying drawings, in which:

FIG. 1 is a side view of one embodiment of a holder of a mophead according to the invention, FIG. 2 is an end view of the clamping member of FIG. 1 with brush bristles attached thereto in one orientation, FIG. 3 is an end view of a modified clamping member having brush bristles attached thereto in a second orientation, FIG. 4 is a side view of another embodiment of a holder of a mophead according to the invention, FIG. 5 is a side view of yet another embodiment of a holder of a mophead according to the invention, and FIG. 6 is a perspective view of a bundle of strands for attachment to the holders of FIGS. 1–5.

Referring firstly to FIGS. 1 and 2 of the drawings, the mophead holder shown therein comprises a body part 10 and an elongate releasable clamping member 11.

The body part 10 has a tubular central portion 12 which defines a socket for receiving a mop handle (not shown), an elongate base portion 13 which co-operates with the releasable clamping member 11 to clamp a bundle of flexible strands to the holder, and two side wings 14 and 15.

The side wing 14 is rigidly connected between the tubular central portion 12 and the base portion 13 and comprises inner and outer rib members 16 and 17, respectively, and a web portion 18 therebetween.

The side wing 15 comprises inner and outer rib members 19 and 20, respectively. The inner rib member 19 is connected between the tubular central portion 12 and the base portion 13. The outer rib member 20 is, however, only connected to the tubular central portion 12. The other end of the outer rib member 20 is free and there is no web portion interconnecting the inner and outer rib members 19 and 20.

The base portion 13 has depending legs 21 and 22, one at either end of the base portion, and a plurality of prongs 23 which are equidistantly spaced apart between the legs 21 and 22.

The releasable clamping member 11 is pivotably connected at one end to the leg 21 and the other end of the clamping member 11 and the leg 22 have mutually co-operable snap fit engagement means (not shown) which can be released by applying pressure to the rib member 19 in the direction of the arrow A to flex the leg 22 outwards to thereby release the engagement means.

As shown in FIG. 2, brush bristles 24 and 25 are secured directly to opposite sides of the clamping member 11 to extend therefrom at an acute angle to a plane of symmetry PS of the mophead and typically at an angle of between about 30° and 45° to the plane of symmetry.

The holder supports a bundle of strands which are clamped between the base portion 13 and the releasable clamping member 11.

A typical strand bundle 30 is shown in FIG. 6 and is made by forming a multiplicity of loops in a single length of elongate flexible material, typically cotton or Syntex. A rectangular blank is then formed by connecting the strands together at positions spaced from, but adjacent to, opposite ends of the strands. The strands are connected adjacent to each of their opposite ends by passing a tape 31*a*, 31*b* around the strands and connecting the upper and lower runs of each tape together by stitching 32.

The strands are gathered together at the centre to define two fan shape parts. Each end of the tape 31*a* is secured to an adjacent end of the tape 31*b* by stitching 33 so that the two tapes 31*a* and 31*b* together form an endless loop securing opposite ends of the strands 30 together.

The width of the strands 30 where gathered together at the centre is at least 7.5 cm, more preferably at least 10 cm, yet more preferably at least 12 cm and typically about 14 cm and the length of the strands from end to end is at least 50 cm, more preferably at least 60 cm and typically about 75 cm.

This will allow the mophead to be used as a conventional "stay flat mophead" in which one half of the mophead folds underneath the other half of the mophead as the two mop halves are trailed behind the holder over a floor surface. It will also allow the mophead to be twirled open so that it can be used in similar manner to a conventional "round mophead" in which the entire underside of the mophead is used for mopping. This will also allow the brush to be used to scrub a floor surface during a mopping operation.

FIG. 3 shows a different orientation of the brush bristles. Once again, there are two groups of brush bristles 24' and 25' one on either side of the clamping member 11', but in this case the brush bristles extend in a direction parallel to the plane of symmetry of the holder. In this case, the handle (not shown) of the mop may extend at angle to the plane of symmetry of the mophead rather than in a direction parallel to the plane of symmetry of the mophead.

The bristles could be replaced by a scrub pad secured to the clamping member.

Alternatively, the brush bristles or scrub pad could be separate from the clamping member and coupled to the underside of the strand bundle 30 by clamping.

FIG. 4 shows a simplified holder in which the body part 10' comprises an elongate base portion 13' and an integral socket 12' for receiving a mop handle. Brush bristles 24' are secured to the clamping member 11' which is pivotably connected at one end to the base portion 13' and which is snap fittably engageable to its other end with the base part 13' to clamp a strand bundle between the is clamping member 11' and the base portion 13' of the body part 10'.

FIG. 5 shows an alternative mop holder in which the body part 10" comprises a base portion 13" and an integral socket 12". Brush bristles 24" are secured to the clamping member 11" which is snap fittably engageable at both ends with the base portion 13" of the body part 10".

The embodiments described above are given by way of example only and various modifications will be apparent to persons skilled in the art without departing from the scope of the invention.

I claim:

1. A mophead comprising a holder and a bundle of flexible strands which are gathered together at a center portion thereof where they are held by the holder, the holder comprising a body part for attachment to a mop handle and a releasable clamping member for releasibly clamping the bundle of strands to the body part of the holder, the clamping member being elongate and hingedly connected at one end to the body part and releasibly connected at the other end with the body part, the holder also supporting a scrubbing member selected from the group consisting of scrub pads and brushes on an underside of the strand bundle.

2. A mophead as claimed in claim 1, wherein the other end of the clamping member is snap fittably engageable with the body part.

3. A mophead as claimed in any one of the preceding claims, wherein the body part of the holder has a plurality of prongs which project into the bundle of strands when the bundle is clamped by the holder.

4. A mophead comprising a holder and a bundle of flexible strands which are gathered together at a center portion thereof where they are held by the holder, the holder comprising a body part for attachment to a mop handle and an elongate, releasible clamping member for releasibly clamping the bundle of strands to the body part of the holder, the holder also supporting a scrubbing member on an underside of the strand bundle, the scrubbing member being comprised of two groups of brush bristles, one on either side of a plane of symmetry of the mophead.

5. The mophead set forth in claim 4 wherein the center portion of the strand bundle has a width of at least 7.5 cm.

6. The mophead set forth in claim 4 wherein the center portion of the strand bundle has a width of at least 10 cm.

7. The mophead set forth in claim 4 wherein the center portion of the strand bundle has a width of at least 12 cm.

8. The mophead set forth in claim 4 wherein each group of brush bristles extends at an acute angle to said plane of symmetry.

* * * * *